US010424265B2

(12) United States Patent
Kim

(10) Patent No.: US 10,424,265 B2
(45) Date of Patent: Sep. 24, 2019

(54) GAMMA VOLTAGE GENERATING CIRCUIT AND LIQUID CRYSTAL DISPLAY DEVICE INCLUDING THE SAME

(71) Applicant: LG DISPLAY CO., LTD., Seoul (KR)

(72) Inventor: MinHwa Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 202 days.

(21) Appl. No.: 14/918,794

(22) Filed: Oct. 21, 2015

(65) Prior Publication Data

US 2016/0118000 A1 Apr. 28, 2016

(30) Foreign Application Priority Data

Oct. 22, 2014 (KR) ..... 10-2014-0143499

(51) Int. Cl.
*G09G 3/36* (2006.01)

(52) U.S. Cl.
CPC ..... *G09G 3/3696* (2013.01); *G09G 3/3688* (2013.01); *G09G 3/3614* (2013.01); *G09G 2310/027* (2013.01); *G09G 2310/0291* (2013.01); *G09G 2320/0673* (2013.01)

(58) Field of Classification Search
CPC .. G09G 3/3696; G09G 3/3688; G09G 3/3614; G09G 2310/0291; G09G 2310/027; G09G 2320/0673
See application file for complete search history.

(56) References Cited

U.S. PATENT DOCUMENTS

| | | | | |
|---|---|---|---|---|
| 9,761,178 | B2 * | 9/2017 | Park | G09G 3/3275 |
| 2005/0007393 | A1 * | 1/2005 | Akai | G09G 3/3233 345/690 |
| 2006/0022929 | A1 | 2/2006 | Hashimoto et al. | |
| 2007/0018922 | A1 * | 1/2007 | Lee | G09G 3/3696 345/89 |
| 2007/0097060 | A1 * | 5/2007 | Takahashi | G09G 3/3614 345/98 |
| 2007/0146395 | A1 * | 6/2007 | Lee | G09G 3/2007 345/690 |
| 2008/0007503 | A1 | 1/2008 | Chiou | |

(Continued)

FOREIGN PATENT DOCUMENTS

| | | | |
|---|---|---|---|
| CN | 1728230 | A | 2/2006 |
| CN | 101101744 | A | 1/2008 |

(Continued)

OTHER PUBLICATIONS

Partial translation of First Office Action dated Jul. 5, 2017, issued in Chinese Patent Application No. 201510691340.8.

(Continued)

*Primary Examiner* — Amare Mengistu
*Assistant Examiner* — Crystal Mathews
(74) *Attorney, Agent, or Firm* — Morgan, Lewis & Bockius LLP

(57) ABSTRACT

The present disclosure relates to a liquid crystal display device, and particularly, to a gamma voltage generating circuit capable of increasing a gamma point without an addition buffer and without increasing a chip size, and a liquid crystal display (LCD) device including the same. By adding a gamma point by utilizing an output buffer for inputting a reference voltage, a gamma curve may be minutely adjusted without increasing cost and a size.

10 Claims, 6 Drawing Sheets

(56) References Cited

U.S. PATENT DOCUMENTS

2009/0051575 A1* 2/2009 Lee ..... G09G 3/20 341/136
2009/0135116 A1 5/2009 Chang
2011/0032279 A1* 2/2011 Kim ..... G09G 3/2007 345/690
2011/0050749 A1 3/2011 Park
2011/0057913 A1* 3/2011 Chung ..... G09G 3/3291 345/211
2011/0175943 A1 7/2011 Ahn et al.
2011/0216098 A1* 9/2011 Choi ..... G09G 5/10 345/690
2012/0162272 A1* 6/2012 Lee ..... G09G 5/10 345/690
2013/0147861 A1* 6/2013 Kim ..... G09G 5/10 345/690
2013/0169693 A1* 7/2013 Pyo ..... G09G 3/3225 345/690
2013/0249969 A1* 9/2013 Jeon ..... G09G 5/10 345/691
2013/0271507 A1* 10/2013 Kim ..... G09G 3/3291 345/690
2014/0055437 A1* 2/2014 Ban ..... H03M 1/66 345/211
2014/0168202 A1* 6/2014 Bae ..... G06F 1/1652 345/214
2015/0170594 A1* 6/2015 Cho ..... G09G 3/3685 345/690
2015/0170609 A1* 6/2015 Jung ..... G09G 3/20 345/212
2015/0206496 A1* 7/2015 Bae ..... G09G 3/3696 348/59
2015/0302788 A1* 10/2015 Kim ..... G09G 3/2007 345/690
2015/0348492 A1* 12/2015 Park ..... G09G 3/3666 345/205
2016/0012763 A1 1/2016 Chen et al.
2016/0125782 A1* 5/2016 Park ..... G09G 3/2003 345/691

FOREIGN PATENT DOCUMENTS

CN 101414452 A 4/2009
CN 101441845 A 5/2009
CN 102157127 A 8/2011
CN 103794187 A 5/2014

OTHER PUBLICATIONS

The Second Office Action dated Feb. 27, 2018 from The State Intellectual Property Office of the People's Republic of China in related Chinese application No. 201510691340.8.

* cited by examiner

GAMMA VOLTAGE GENERATING CIRCUIT AND LIQUID CRYSTAL DISPLAY DEVICE INCLUDING THE SAME

CROSS-REFERENCE TO RELATED APPLICATION

Pursuant to 35 U.S.C. § 119(a), this application claims the benefit of earlier filing date and right of priority to Korean Application No. 10-2014-0143499, filed on Oct. 22, 2014, the contents of which is incorporated by reference herein in its entirety.

BACKGROUND OF THE INVENTION

1. Field of the Invention

The present disclosure relates to a liquid crystal display device, and particularly, to a gamma voltage generating circuit capable of increasing a gamma point without an addition buffer and without increasing a chip size, and a liquid crystal display (LCD) device including the same.

2. Background of the Invention

A flat panel display (FPD) is an essential display device for realizing a small, lightweight system such as portable computers, e.g., a notebook computer or a PDA, as well as a desktop computer, or a cellular phone terminal, to replace a conventional cathode ray tube (CRT) display device. Currently commercialized flat panel display devices include an LCD device, and a plasma display panel (PDP), an organic light emitting display device. Among them, LCDs have come to prominence as display devices used in mobile devices, monitors of computers, and HDTVs due to advantages thereof such as excellent visibility, ease in a reduction in thickness, low power consumption, and low heating.

A general display device includes a gate driver generating a gate driving voltage upon receiving a control signal from a timing controller, and sequentially supplying the generated gate driving voltage to gate lines to turn on thin film transistors (TFTs) connected to the gate lines, a data driver receiving a control signal and image data from the timing controller and applying a data voltage to the image data to a data line, and the timing controller controlling the gate driver and the data driver.

In particular, the data driver converts an input image data of a digital waveform into a data voltage of an analog waveform by using a predetermined gamma voltage. Here, the gamma voltage is an analog voltage corresponding to a gray level value of each image data, and a gamma voltage generating circuit generates a plurality of positive and negative gamma voltages respectively corresponding to gray level values and supplying the generated positive and negative gamma voltages to the data driver, and the data driver converts the image data into a data voltage by using a corresponding gamma voltage and outputs the converted data voltage.

FIG. 1 is a view schematically illustrating a gamma voltage generating circuit provided in a related art liquid crystal display (LCD) device.

Referring to FIG. 1, the related art gamma voltage generating circuit 40 includes a first resistor string 41 in which a plurality of first resistors R1 dividing two reference voltages Vref1 and Vref2 are connected in series, a decoder unit 45 selecting voltages divided by the first resistor string 41 by a selection signal SEL to generate a predetermined number of gamma reference voltages, a buffer unit 46 outputting the generated gamma reference voltages, and a second resistor string 47 in which a plurality of second resistors R2 dividing the gamma reference voltages to generate a plurality of gamma voltages GMA0 to GMA 255 are connected in series.

Since the gamma voltage generating circuit 40 having the foregoing structure may selectively generate the gamma reference voltages by using the divided voltages input to the decoder unit 45, the gamma voltages may be easily adjusted, compared with an existing scheme of using a variable resistor.

In the gamma voltage generating circuit 40, the output buffer unit 46 is provided to uniformly maintain a voltage level of a gamma reference voltage to generate a stable gamma curve with a minimized error. The output buffer unit 46 is connected to five gamma points P1 to P5 and outputs five gamma reference voltages to the second resistor string 47. Thus, the decoder unit 45 is formed as at least five decoders (not shown), and the buffer unit 46 needs to include five output buffers ob1 to ob5.

Thus, in a case in which a gamma reference voltage is intended to be added in order to minutely adjust a gamma curve, a separate gamma point should be defined and a buffer connected thereto should be added. This inevitably leads to an increase in component unit cost due to the increase in the number of buffers, and an increase in an IC size in which the gamma voltage generating circuit is integrated.

SUMMARY OF THE INVENTION

Accordingly, the present invention is directed to a gamma voltage generating circuit and a liquid crystal display device including the same that substantially obviate one or more of the problems due to limitations and disadvantages of the related art.

An object of the present invention is to provide a gamma voltage generating circuit in which a gamma point is added in order to minutely adjust a gamma curve, without adding an output buffer and increasing an IC size, and a liquid crystal display device including the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of this specification, as embodied and broadly described herein, a gamma voltage generating circuit comprises a first gamma voltage generating unit configured to generate positive gamma voltages and a second gamma voltage generating unit configured to generate negative gamma voltages.

Here, upon receiving first and second reference voltages, the first gamma voltage generating unit may generate first positive gamma reference voltages including the first and second reference voltages and second positive gamma reference voltages obtained by dividing the first and second reference voltages, and divide the positive gamma reference voltages to generate a plurality of positive gamma voltages.

Similarly, upon receiving third and fourth reference voltages, the second gamma voltage generating unit may generate first negative gamma reference voltages including the third and fourth reference voltages, generate second negative gamma reference voltages obtained by dividing the third and fourth reference voltages, and divide the negative gamma reference voltages to generate a plurality of negative gamma voltages. Thus, a total of fourteen gamma points may be set.

In another aspect, a liquid crystal display device comprises a liquid crystal panel; a gate driver configured to apply a gate driving voltage to the liquid crystal panel; a data driver configured to convert image data into a data voltage through a plurality of gamma voltages, and applying the converted data voltage to the liquid crystal panel; a timing controller configured to control the gate driver and the data driver; and a power supply unit configured to output a plurality of source voltages. The liquid crystal display device may further include: a gamma voltage generating circuit configured to receive first to fourth reference voltages, generate first gamma reference voltages including the first to fourth reference voltages and second gamma reference voltages obtained by dividing the first to fourth reference voltages, and divide the first and second gamma reference voltages to generate the plurality of gamma voltages.

According to embodiments of the present disclosure, the gamma voltage generating circuit and the liquid crystal display device including the same, capable of minutely adjusting a gamma curve without increasing cost and a size by adding a gamma point by utilizing an output buffer for inputting a reference voltage to the gamma voltage generating circuit may be implemented.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings.

DETAILED DESCRIPTION OF THE ILLUSTRATED EMBODIMENTS

Figure 1:
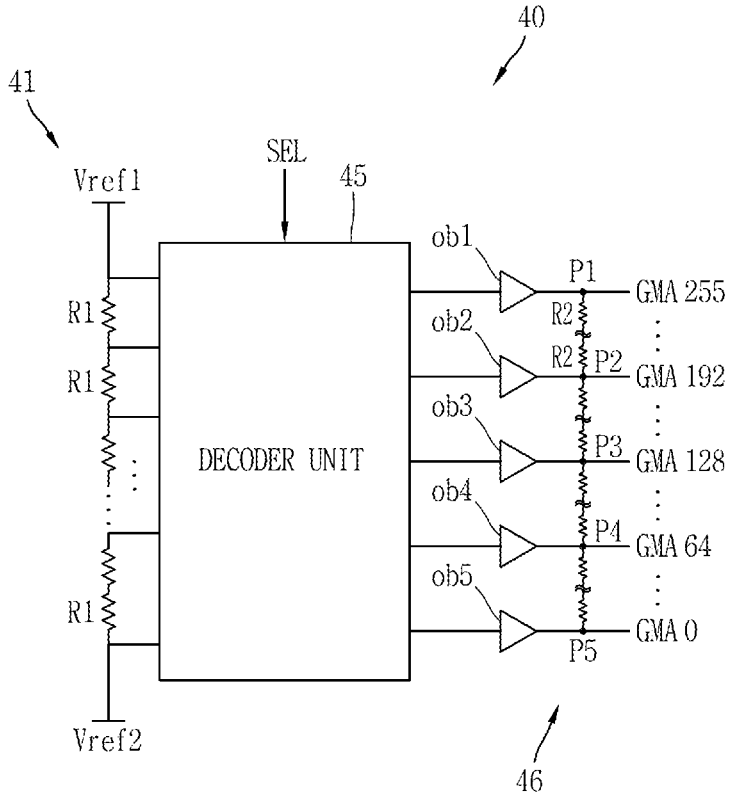
FIG. 1 RELATED ART
FIG. 1 is a view schematically illustrating a gamma voltage generating circuit provided in the related art liquid crystal display (LCD) device.

Hereinafter, a gamma voltage generating circuit and a liquid crystal display device including the same according to exemplary embodiments of the present disclosure will be described with reference to the accompanying drawings.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

A shape, a size, a ratio, an angle, and a number disclosed in the drawings for describing embodiments of the present invention are merely an example, and thus, the present invention is not limited to the illustrated details. Like reference numerals refer to like elements throughout. In the following description, when the detailed description of the relevant known function or configuration is determined to unnecessarily obscure the important point of the present invention, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when two portions are described as "~on", "~above", "~below", or "~on the side", one or more other portions may be positioned between the two portions unless "immediately" or "directly" is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present invention.

Features of various embodiments of the present invention may be partially or overall coupled to or combined with each other, and may be variously inter-operated with each other and driven technically as those skilled in the art can sufficiently understand. The embodiments of the present invention may be carried out independently from each other, or may be carried out together in co-dependent relationship.

Figure 2:
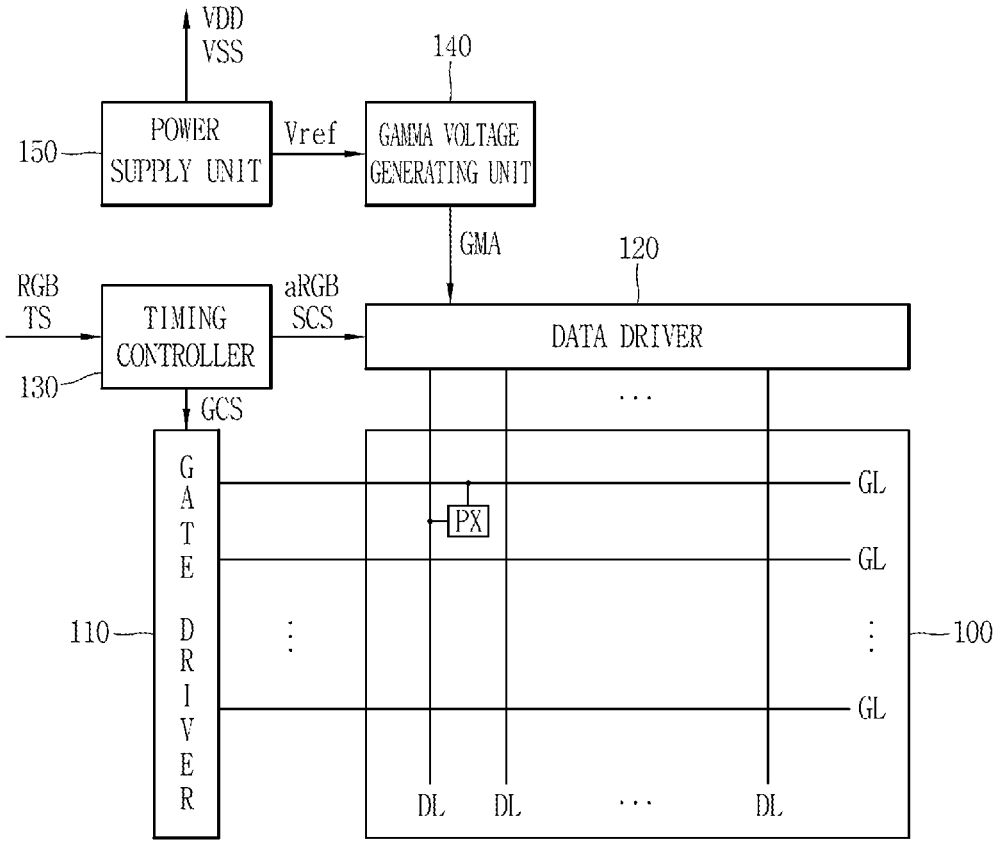
FIG. 2 is a view illustrating an overall structure of a gamma voltage generating circuit and an LCD device including the same according to an example embodiment of the present disclosure.

FIG. 2 is a view illustrating an overall structure of a gamma voltage generating circuit and an LCD device including the same according to an example embodiment of the present disclosure.

Referring to FIG. 2, the LCD device including a gamma voltage generating circuit according to an example embodiment of the present disclosure includes a liquid crystal panel 100, a gate driver 110 applying a gate driving voltage Vg to the liquid crystal panel 100, a data driver 120 converting image data aRGB into a data voltage Vdata through a plurality of gamma voltages GMA and applying the converted data voltage to the liquid crystal panel 100, a timing controller 130 controlling the gate driver 110 and the data driver 120, and a power supply unit 150 outputting a plurality of source voltages VDD and VSS, and further includes a gamma voltage generating circuit 140 receiving first to fourth reference voltages Vref, generating a first gamma reference voltage including the first to fourth reference voltages Vref and a second gamma reference voltage obtained by dividing the first to fourth reference voltages, and generating a plurality of gamma voltages by dividing the first and second gamma reference voltages.

In the liquid crystal panel 100, a plurality of gate lines GL and a plurality of data lines DL are formed to intersect with each other in a matrix form on a substrate formed of glass or plastic, and a plurality of pixels PX are defined at the intersections. Each pixel PX includes at least one thin film transistor (TFT) and a liquid crystal capacitor (not shown).

A gate electrode of the foregoing TFT is connected to the gate line GL, a source electrode thereof is connected to the data line DL, and a drain electrode thereof is connected to a pixel electrode facing a common electrode to control a voltage applied to the liquid crystal capacitor.

In response to the gate control signal (GCS) input from the timing controller 130, the gate driver 110 outputs a gate driving voltage Vg sequentially by one horizontal period each time through the gate line GL formed in the liquid crystal panel 100. Thus the TFT connected to each of the gate lines GL is turned on by one horizontal period each time, and the data driver 120, in synchronization therewith, outputs the data voltage Vdata of an analog waveform through the data lines D1 to DLm such that the voltage data Vdata may be applied to the pixels PX connected to the TFTs.

The gate control signal includes a gate start pulse (GSP), a signal for determining a time at which the gate driving signal is to be output to a first gate line GL1, is applied to a shift register (not shown) of the gate driver 110, a gate shift clock (GSC) as a clock signal commonly applied to each shift register and enabling a next shift register, and a gate output enable signal (GOE) controlling an output of a shift register.

In response to the source control signal SCS input from the timing controller 130, the data driver 120 converts image data aRGB in a digital form into a data voltage Vdata in an analog form according to a reference voltage, and outputs the converted data voltage Vdata to the liquid crystal panel 100 through the data line DL. Although not shown, the data driver 120 includes a predetermined latch and a DAC (not shown). After the data driver 120 latches the image data by one horizontal line each time and converts the image data by using a gamma voltage GMA, the data driver 120 applies the data voltage Vdata of the analog waveform to each pixel PX of the liquid crystal panel 100.

The source control signal SCS includes a source start pulse (SSP) for determining a sampling start timing of image data, a source shift clock (SSC) as a clock signal for controlling a data sampling operation in the data driver 120, and a source output enable signal (SOE) controlling an output of the data driver 120.

The timing controller 130 receives image data RGB in a digital form and a timing signal TS such as horizontal and vertical synchronization signals and a data enable clock signal transmitted from an external system (not shown), and generates control signals GCS and SCS of the gate driver 110 and the data driver 120.

Here, the timing controller 130 receives the image data RGB through a predetermined interface, aligns (aRGB) the input image data RGB in a form that can be processed by the data driver 120, and outputs the same.

The gamma voltage generating circuit 140 receives a reference voltage Vref supplied from the power supply unit 150, divides the received reference voltage Vref to generate a plurality of gamma voltages GMA, and supplies the plurality of generated gamma voltages GMA to the data driver 120.

When the LCD device is driven by 8 bits, the gamma voltage GMA corresponds to 0 to 255 gray levels. Also, when the LCD device is driven by 6 bits, the gamma voltage GMA corresponds to 0 to 127 gray levels. The gamma voltage GMA is generated by dividing a predetermined gamma reference voltage, and the gamma reference voltage is determined by receiving at least two reference voltages Vref defining an upper limit and a lower limit of a gamma voltage, dividing the at least two received reference voltages Vref, and selecting a predetermined number of divided voltages from among a plurality of divided voltages by using a decoder.

In general, in a case in which gamma voltages GMS having 255 gray levels are to be generated, at least five gamma reference voltages are required. Also, in order to perform polarity reversal driving to prevent a degradation of liquid crystal, the LCD device requires a positive gamma voltage and a negative gamma voltage, and thus, at least ten gamma reference voltages are required.

The ten gamma reference voltages are representative values with respect to a gamma curve. The ten gamma reference voltages are set as gamma points and spaces between the points are divided into a predetermined number to thereby extract gamma voltages GMA. The gamma voltages GMA are connected to form a gamma curve.

Here, when the gamma reference voltage is changed, the overall gamma curve is distorted, and thus, a buffer needs to be provided for the gamma points such that the gamma points are designed to be resistant to distortion. Thus, in a case in which a gamma point is intended to be added for minutely adjusting a gamma voltage, a buffer is required to be added.

However, in an example embodiment of the present disclosure, the gamma voltage generating circuit 140 utilizes a buffer for receiving the reference voltage Vref, as a buffer of a gamma point, to this increase the gamma point without using an additional buffer. Since at least two reference voltages are input, at least two gamma points may be added, and as the two gamma points are divided into positive and negative gamma points, a total of four gamma points may be added. An internal structure of the gamma voltage generating circuit 140 will be described in detail hereinafter.

The power supply unit 160 generates a sound voltage VDD, a ground voltage, and various other voltages for driving the LCD device, and provides the generated voltages to each driver. In particular, the power supply unit 160 provides the reference voltage Vref for generating a gamma voltage GMA to the gamma voltage generating circuit 140, and as described above, in an example embodiment of the present disclosure, a buffer which receives the reference voltage Vref is utilized as a buffer of a gamma point, and thus, a reference voltage Vref output terminal of the power supply unit 160 is directly connected to the buffer of the gamma point.

According to this structure, in the LCD device including the gamma voltage generating circuit according to an example embodiment of the present disclosure, a gamma curve may be minutely adjusted without increasing cost by adding gamma points without using an additional buffer.

The gamma voltage generating circuit 140 may be implemented in a form of a separate IC without using a variable resistor, or the like, or may be integrated within the data driver 120. Hereinafter, a structure of the data driver 120 outputting a data voltage Vdata of an analog waveform by using the gamma voltage GMA generated by the gamma voltage generating circuit 140 will be described in detail.

Figure 3:
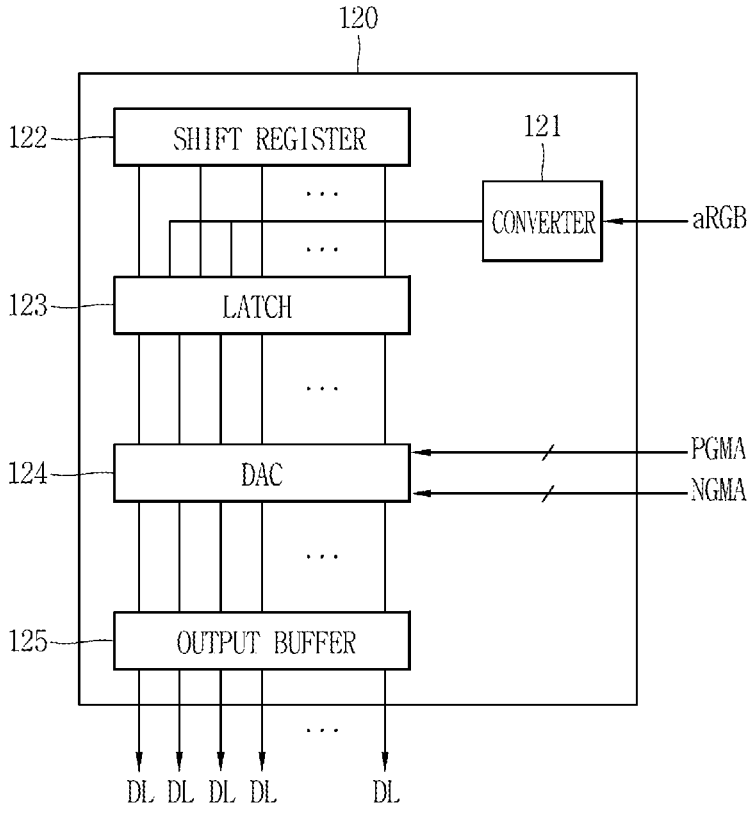
FIG. 3 is a view illustrating a data driver of the LCD device including the gamma voltage generating circuit according to an example embodiment of the present disclosure.

FIG. 3 is a view illustrating a data driver of the LCD device including a gamma voltage generating circuit according to an example embodiment of the present disclosure.

Referring to FIG. 3, the data driver of the LCD device according to an example embodiment of the present disclosure includes a converter 121, a shift register 122, a latch 123, a DAC 124, and an output buffer 125.

The converter 121 converts image data aRGB of a digital waveform in a serial form input from the timing controller into a parallel form, and delivers the converted data to the latch 123. The image data aRGB is data obtained by aligning the original image data by the timing controller.

The shift register 123 shifts a control signal, that is, a source start pulse (SSP), applied from the timing controller according to a source sampling clock (SSC) to generate a sampling signal, and delivers the generated sampling signal to the latch 123.

In response to sampling signals sequentially input from the shift register 123, the latch 123 samples digital data RGB input from the converter 121, and delivers the sampled digital data aRGB to the DAC 124.

The DAC 124 selects a gamma voltage corresponding to the digital data aRGB received from the latch 123 and delivers the selected gamma voltage to the output buffer 125. That is, the DAC 124 converts the digital data received from the latch 155 into a data voltage Vdata as an analog voltage by using positive and negative gamma voltages PGMA and NGMA, and delivers the converted data voltage Vdata to the output buffer 125. To this end, the DAC 124 may include positive and negative converters. For example, the positive and negative gamma voltages PGMA and NGMA have a voltage level regarding each of 255 gray levels, and the DAC 124 outputs the gamma voltages PGMA and NGMA corresponding to the digital data aRGB delivered from the latch 155, as the data voltage Vdata.

The output buffer 125 outputs the data voltage Vdata received from the DAC 124 to the liquid crystal panel through a plurality of data lines DL. The output buffer 125 serves to prevent signal delay of the data voltage Vdata from a resistance component of the data line DL and a resistance component based on each pixel region.

The gamma voltages PGMA and NGMA are generated by the gamma voltage generating circuit provided in outside or installed within the data driver 140. Hereinafter, a structure of the gamma voltage generating circuit according to an example embodiment of the present disclosure will be described with reference to the accompanying drawings.

Figure 4:
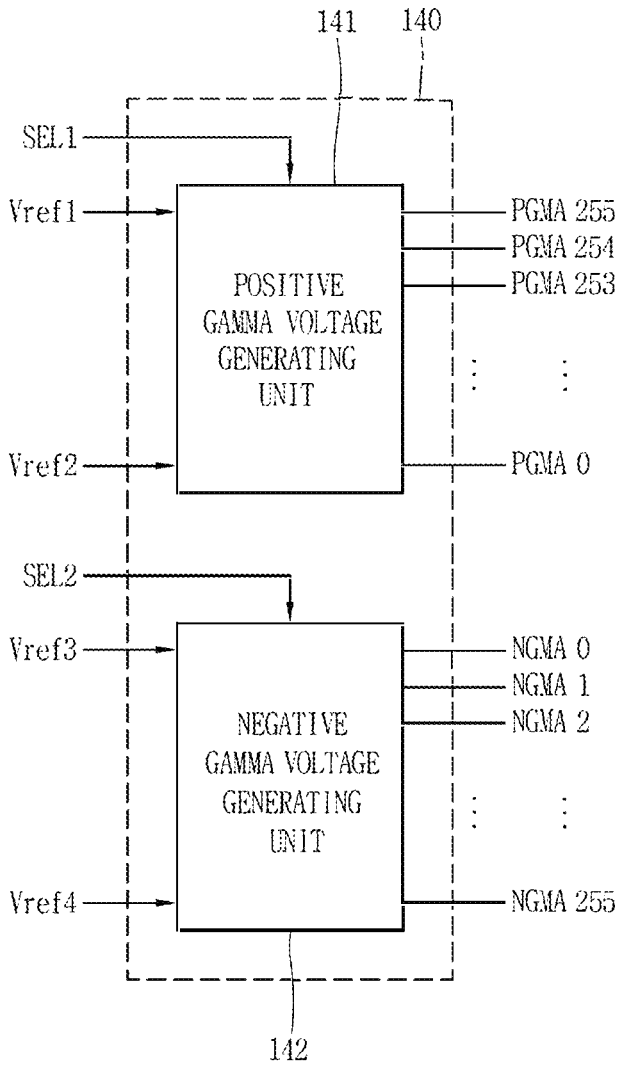
FIG. 4 is a view illustrating the gamma voltage generating circuit according to an example embodiment of the present disclosure.

FIG. 4 is a view illustrating the gamma voltage generating circuit according to an example embodiment of the present disclosure.

Referring to FIG. 4, the gamma voltage generating circuit 140 according to an example embodiment of the present disclosure includes a first gamma voltage generating unit 141 and a second gamma voltage generating unit 142. The first gamma voltage generating circuit 141 generates first positive gamma reference voltages including first and second reference voltages Vref1 and Vref2, upon receiving the first and second reference voltages Vref1 and Vref2, generates second positive gamma reference voltages obtained by dividing the first and second reference voltages Vref1 and Vref2, and divides the first and second positive gamma reference voltages to generate a plurality of positive gamma voltages PGMA0 to PGMA255. The second gamma voltage generating unit generates first negative gamma reference voltages including third and fourth reference voltages Vref3 and Vref4, upon receiving the third and fourth reference voltages Vref3 and Vref4, and second negative gamma reference voltages obtained by dividing the third and fourth reference voltages Vref3 and Vref4, and divides the first and second negative gamma reference voltages to generate a plurality of negative gamma voltages NGMA0 to NGMA255.

Each of the gamma voltage generating units 141 and 142 include a plurality of resistor strings and decoders, and also includes a plurality of buffers to output first and second gamma reference voltages set as gamma points. The first and second gamma reference voltages may be minutely adjusted by first and second select signals SEL1 and SEL2, and the first and second select signals SEL1 and SEL2 may be supplied by a timing controller or a control unit (not shown) within the data driver.

Also, the first gamma voltage generating unit 141 generates the positive gamma voltages PGMA0 to PGMA255, and the first and second reference voltages Vref1 and Vref2 may be set as a source voltage VDD and a first half source voltage HVDD1.

The second gamma voltage generating unit 142 generates negative gamma voltages NGMA0 to NGMA255, and the third and fourth reference voltages Vref3 and Vref4 may be set as a second half source voltage HVDD2 and a ground voltage VSS.

Here, the first and second half source voltages HVDD1 and HVDD2 are set to have a level equal to a middle level of the source voltage VDD and the ground voltage VSS, and have a difference of about ±0.1V from each other according to an intention of a designer. For example, when the source voltage VDD is 8V and the ground voltage VSS is 0V, the first and second half source voltages HVDD1 and HVDD2 may be set to 4.1V and 3.9V, which are respectively ±0.1V to and from the middle level 4V.

Figure 5A:
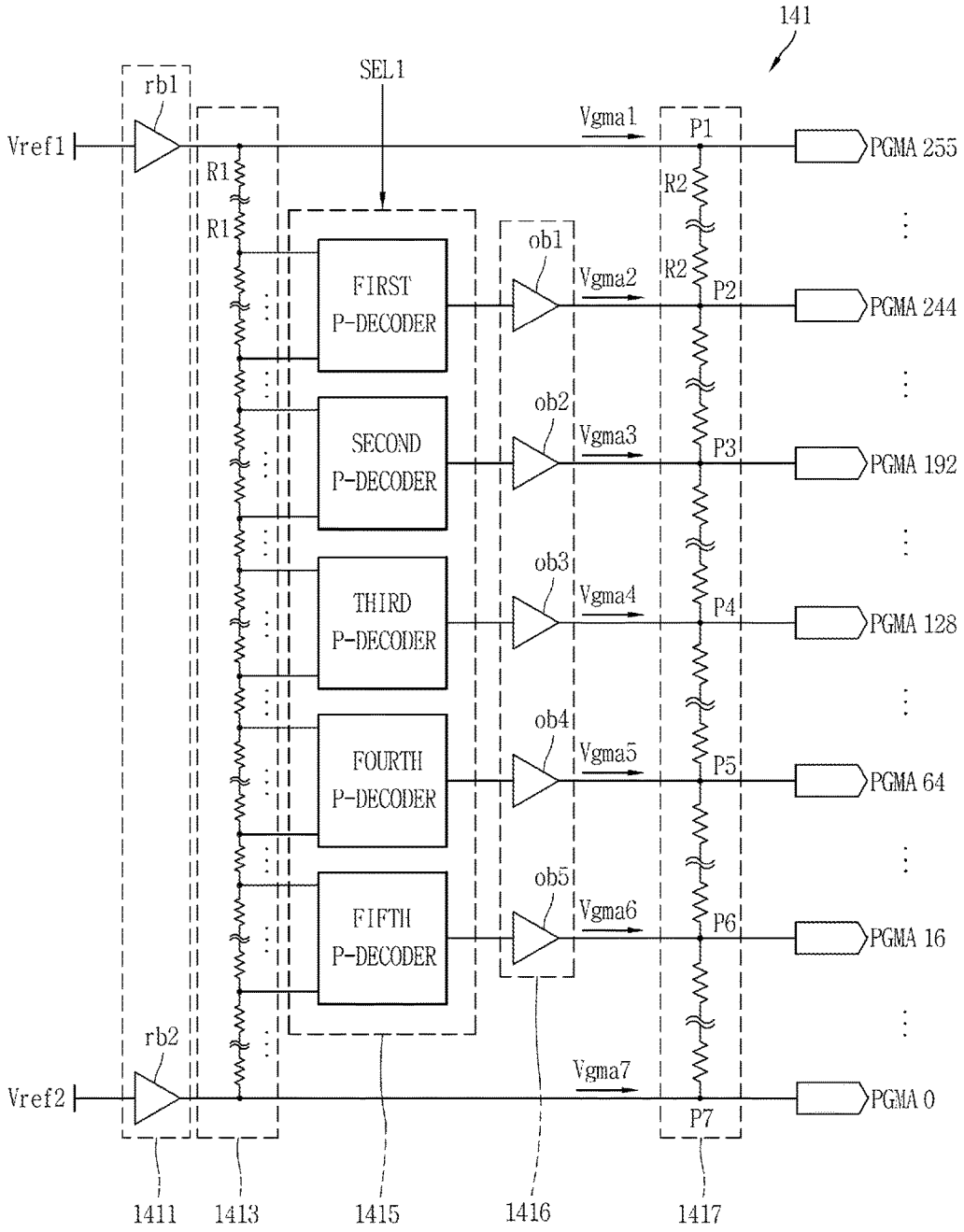
FIGS. 5A and 5B are views specifically illustrating structures of first and second gamma voltage generating units of the gamma voltage generating circuit of FIG. 4, respectively.
Figure 5B:
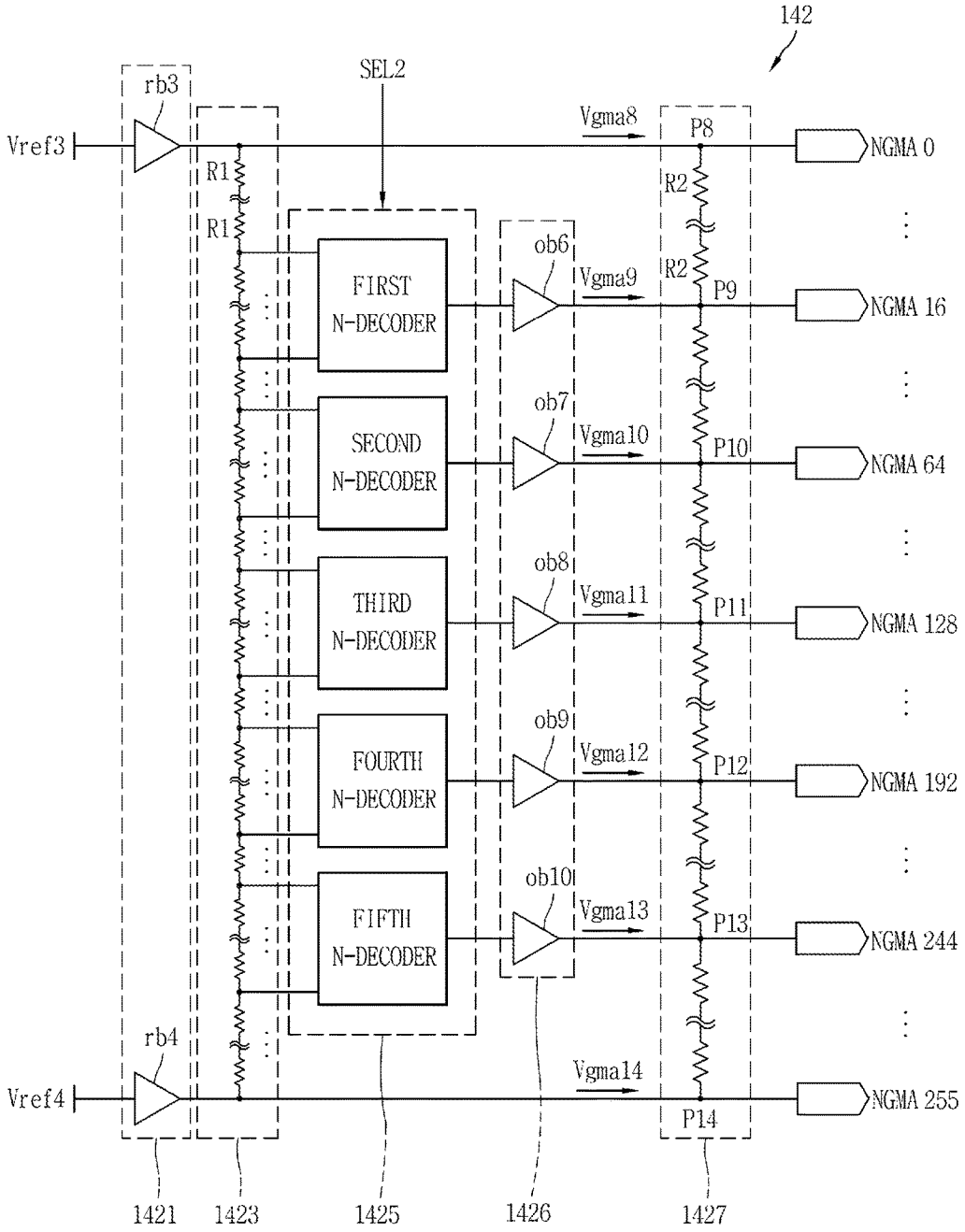

FIGS. 5A and 5B are views specifically illustrating structures of first and second gamma voltage generating units of the gamma voltage generating circuit of FIG. 4, respectively.

First, referring to FIG. 5A, the first gamma voltage generating unit 141 of the gamma voltage generating circuit according to an example embodiment of the present disclosure includes a first output buffer unit 1411 outputting the first and second reference voltages Vref1 and Vref2 as first positive gamma reference voltages Vgma1 and Vgma7, a first resistor string 1413 dividing the first and second reference voltages Vref1 and Vref2, a P-decoder unit 1415 generating second positive gamma reference voltages Vgam2 to Vgma6 through the divided voltage from the first resistor string 1413 in response to a first selection signal SEL1, a second output buffer unit 1416 outputting the second positive gamma reference voltages Vgma2 to Vgma6, and a second resistor string 1417 dividing the first and second positive gamma reference voltages Vmga1 to Vgma7 and outputting the plurality of positive gamma voltages.

The first output buffer unit 1411 include two first output buffers rb1 and rb2 stabilizing the first and second reference voltages Vref1 and Vref2 provided from a power supply unit and outputting the first positive gamma reference voltages Vgma1 and Vgma7. The first positive gamma reference voltages Vgma1 and Vgma7 are set as first and seventh gamma points P1 and P7.

The first resistor string 1413 is provided between the first output buffer unit 1411 and the P-decoder unit 1415 and includes a plurality of resistors R1 connected in series. The first resistor string 1413 divides a voltage between the first and second reference voltages Vref1 and Vref2 and delivers the divided voltage to the P-decoder unit 1415.

The P-decoder unit 1415 includes five first to fifth P decoders and generates the second positive gamma reference voltages Vgma2 to Vgma6 from a plurality of voltages output from the first resistor string 1413 in response to the first selection signal SEL1. The first selection signal SEL1 is binary data, and any one of intermediate values of the plurality of voltages input to the P-decoders is selected and output as a positive gamma reference voltage.

The second output buffer unit 1416 includes five second output buffers ob1 to ob5 respectively connected to the first to fifth P-decoders of the P-decoder unit 1415. The second output buffer unit 1416 stabilizes the second positive gamma reference voltages Vgma2 to Vgma6 delivered from the P-decoder unit 1415 and outputs the stabilized second positive gamma reference voltages Vgma2 to Vgma6.

The second resistor string 1417 is connected to the first and second output buffer units 1411 and 1416. The second resistor string 1417 includes a plurality of resistors R2 connected in series and have first to seventh gamma points P1 to P7 defined therein. The gamma points P1 to P7 are connected to the first and second output buffer units 1411 and 1416.

In detail, the first output buffers rb1 and rb2 output first positive gamma reference voltages Vgma1 and Vgma7, and the second output buffers ob1 to ob6 output second positive gamma reference voltages Vgma2 to Vgma6. The positive gamma reference voltages Vgma1 to Vgma7 are output to the gamma points P1 to P7, and the second resistor string 1417 divides an intermediate voltage between each of two positive gamma reference voltages to generate 0 to 255 positive gamma voltages (PGMA0 to PGMA255).

For example, two positive gamma reference voltages Vgma1 and Vgma2 are respectively applied to the first and second gamma points P1 and P2, and as the resistors R2 between the first and second gamma points P1 and P2 divide the two positive gamma reference voltages Vgma1 and Vgma2, twelve positive gamma voltages of 244 positive gamma voltage PGMA 244 are generated from 255 positive gamma voltage PGMA 255.

As described above, the first gamma voltage generating unit 141 according to the present disclosure may generate a total of seven first and second gamma reference voltages Vgma1 to Vgma7 by the two first output buffers rb1 and rb2 to which the first and second reference voltages Vref1 and Vref2 are input and five second output buffers ob1 to ob5 connected to the P-decoder unit 1415. Thus, compared with the related art, two more gamma points may be set without using an additional buffer and without increasing an IC size.

FIG. 5B illustrates the second gamma voltage generating unit 142 of the gamma voltage generating circuit according to an example embodiment of the present disclosure.

Referring to FIG. 5B, the second gamma voltage generating unit 142 includes a first output buffer unit 1421 outputting the third and fourth reference voltages Vref3 and Vref4 as first negative gamma reference voltages Vgma8 and Vgma14, a first resistor string 1423 dividing the third and fourth reference voltages Vref3 and Vref4, a P-decoder unit 1425 generating second negative reference voltages Vgma9 to Vgma13 through divided voltages from the first resistor string 1423 in response to a second selection signal SEL2, a second output buffer unit 1426 outputting the second negative gamma reference voltages Vgma 9 to Vgma 13, and a second resistor string 1427 dividing the third and fourth negative gamma reference voltages Vgma8 and Vgma14 and outputting a plurality of negative gamma voltages.

The first output buffer unit 1421 include two first output buffers rb3 and rb4 stabilizing the third and fourth reference voltages Vref3 and Vref4 provided from a power supply unit and outputting the first negative gamma reference voltages Vgma8 and Vgma14. The first negative gamma reference voltages Vgma 8 and Vgma 14 are set as eighth and fourteenth gamma points P8 and P14, respectively.

The first resistor string 1432 is provided between the first output buffer unit 1421 and the N-decoder unit 1425, and includes a plurality of resistors R1 connected in series. The first resistor storing 1423 divides a voltage between the third and fourth reference voltages Vref3 and Vref4 in a predetermined unit and delivers the divided voltages to the N-decoder unit 1425.

The N-decoder unit 1425 includes five first to fifth N-decoders and generates second negative gamma reference voltages Vgma9 to Vgma13 from a plurality of voltages output from the first resistor string 1423 in response to the second selection signal SEL2. The second selection signal SEL2 is binary data, and any one of intermediate values of the plurality of voltages input to the N-decoders is selected and output as a negative gamma reference voltage.

The second output buffer unit 1216 includes five second output buffers ob6 to ob10 respectively connected to the first to fifth N-decoders of the N-decoder unit 1425. The second output buffer unit 1426 stabilizes the second negative gamma reference voltages Vgma9 to Vgma13 delivered from the N-decoder unit 1425 and outputs the stabilized second negative gamma reference voltages Vgma9 to Vgma13.

The second resistor string 1427 is connected to the first and second output buffer units 1421 and 1426. The second resistor string 1427 includes a plurality of resistors R2 connected in series and have eighth to fourteenth gamma points P8 to P14 defined therein. The gamma points P8 to P14 are connected to the first and second output buffer units 1421 and 1426.

In detail, the first output buffers rb3 and rb4 output first negative gamma reference voltages Vgma8 and Vgma14, and the second output buffers ob6 to ob10 output second negative gamma reference voltages Vgma9 to Vgma13. The negative gamma reference voltages Vgma8 to Vgma14 are output to the gamma points P8 to P14, and the second resistor string 1427 divides an intermediate voltage between each of two positive gamma reference voltages to generate 0 to 255 negative gamma voltages (NGMA0 to NGMA255).

For example, two negative gamma reference voltages Vgma13 and Vgma14 are respectively applied to the thirteenth and fourteenth gamma points P13 and P14, and as the resistors R2 between the thirteenth and fourteenth gamma points P13 and P14 divide the two negative gamma reference voltages Vgma13 and Vgma14, twelve negative gamma voltages of 255 negative gamma voltage NGMA255 are generated from 244 negative gamma voltage NGMA 244.

As described above, the second gamma voltage generating unit 142 according to the present disclosure may generate a total of seven first and second gamma reference voltages Vgma8 to Vgma14 by the two first output buffers rb3 and rb4 to which the third and fourth reference voltages Vref3 and Vref4 are input and five second output buffers ob6 to ob10 connected to the N-decoder unit 1425. Resultantly, a total of fourteen first and second gamma reference voltages Vgma1 to Vgma14, together with the first and second gamma reference voltages Vgma1 to Vmga7 of the first gamma voltage generating unit 141, may be generated, and thus, a total of four more gamma points may be set.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

It will be apparent to those skilled in the art that various modifications and variations can be made in the a gamma voltage generating circuit and a liquid crystal display device including the same of the present invention without departing from the spirit or scope of the invention. Thus, it is intended that the present invention cover the modifications and variations of this invention provided they come within the scope of the appended claims and their equivalents.

What is claimed is:

1. A gamma voltage generating circuit, comprising:

a first gamma voltage generating unit configured to generate, upon receiving first and second reference voltages, first positive gamma reference voltages including the first and second reference voltages, and second positive gamma reference voltages obtained by dividing the first and second reference voltages, and divide the first and second positive gamma reference voltages to generate a plurality of positive gamma voltages; and a second gamma voltage generating unit configured to generate, upon receiving third and fourth reference voltages, first negative gamma reference voltages including the third and fourth reference voltages, and second negative gamma reference voltages obtained by dividing the third and fourth reference voltages, and divide the first and second negative gamma reference voltages to generate a plurality of negative gamma voltages, wherein the first gamma voltage generating unit comprises a first output buffer unit configured to output the first and second reference voltages as the first positive gamma reference voltages, wherein the second gamma voltage generating unit comprises a first output buffer unit configured to output the third and fourth reference voltages as the first negative gamma reference voltages, wherein the first gamma voltage generating unit further comprises a first resistor string and a second resistor string, and one end of the first resistor string of the first gamma voltage generating unit is directly connected to an output terminal of the first output buffer unit and one end of the second resistor string of the first gamma voltage generating unit, wherein the second gamma voltage generating unit further comprises a first resistor string and a second resistor string, and one end of the first resistor string of the second gamma voltage generating unit is directly connected to an output terminal of the first output buffer unit and one end of the second resistor string of the second gamma voltage generating unit, wherein the first and second reference voltages are set as a source voltage (VDD) and a first half source voltage (HVDD1) of a power supply unit, respectively, and the third and fourth reference voltages are set as a second half source voltage (HVDD2) and a ground voltage (VSS) of the power supply unit, respectively, and wherein the first and second gamma voltage generating units are configured to receive respective first and second selection signals from a timing controller to respectively adjust the positive gamma voltages and the negative gamma voltages.

2. The gamma voltage generating circuit of claim 1, wherein the first gamma voltage generating unit further comprises:

the first resistor string configured to divide the first and second reference voltages;

a P-decoder unit configured to generate the second positive gamma reference voltages through the divided voltages from the first resistor string in response to the first selection signal;

a second output buffer unit configured to output the second positive gamma reference voltages; and the second resistor string configured to divide the first and second positive gamma reference voltages and output the plurality of positive gamma voltages.

3. The gamma voltage generating circuit of claim 2, wherein output terminals of the first and second output buffer units are connected to first to seventh gamma points defined in the second resistor string.

4. The gamma voltage generating circuit of claim 3, wherein an input terminal of the first output buffer unit is directly connected to a source voltage terminal (VDD) and a first half source voltage terminal (HVDD1) of the power supply unit, and an input terminal of the second output buffer unit is connected to an output terminal of the P-decoder unit.

5. The gamma voltage generating circuit of claim 2, wherein the second gamma voltage generating unit further comprises:

the first resistor string configured to divide the third and fourth reference voltages;

an N-decoder unit configured to generate the second negative gamma reference voltages through the divided voltages from the first resistor string in response to the second selection signal;

a second output buffer unit configured to output the second negative gamma reference voltages; and the second resistor string configured to divide the first and second negative gamma reference voltages and output a plurality of negative gamma voltages.

6. The gamma voltage generating circuit of claim 5, wherein the output terminals of the first and second output buffer units are connected to eighth to fourteenth gamma points defined in the second resistor string.

7. The gamma voltage generating circuit of claim 6, wherein an input terminal of the first output buffer unit is directly connected to a second half source voltage terminal (HVDD2) of the power supply unit and a ground terminal (VSS), and an input terminal of the second output buffer unit is connected to an output terminal of the N-decoder unit.

8. The gamma voltage generating circuit of claim 1, wherein the first resistor string divides the first and second reference voltages, and wherein the first resistor string divides the third and fourth reference voltages.

9. The gamma voltage generating circuit of claim 1, wherein the first resistor string of the first gamma voltage generating unit includes only a plurality of fixed resistors connected in series, and wherein the first resistor string of the second gamma voltage generating unit includes only a plurality of fixed resistors connected in series.

10. The gamma voltage generating circuit of claim 1, wherein the first and second half source voltages (HVDD1, HVDD2) have a difference of 0.1V from each other.

* * * * *